United States Patent [19]

Schönwald

[11] 3,942,906

[45] Mar. 9, 1976

[54] SIDE CHANNEL RING COMPRESSOR

[75] Inventor: Siegfried Schönwald, Bad Neustadt, Germany

[73] Assignee: Siemens Aktiengesellschaft, Munich, Germany

[22] Filed: Feb. 13, 1975

[21] Appl. No.: 549,782

[30] Foreign Application Priority Data

Feb. 26, 1974 Germany ..... 2409184

[52] U.S. Cl. ..... 415/53 T; 415/213 T

[51] Int. Cl.[2] ..... F04D 5/00; F04D 23/00

[58] Field of Search ..... 415/53 T, 213 T, 58

[56] References Cited

UNITED STATES PATENTS

| | | | |
|---|---|---|---|
| 1,529,815 | 3/1925 | Siemen | 415/53 T |
| 2,842,062 | 7/1958 | Wright | 415/53 T |
| 3,095,820 | 7/1963 | Sanborn | 415/53 T |
| 3,788,766 | 1/1974 | Engels | 415/53 T |

*Primary Examiner*—Carlton R. Croyle
*Assistant Examiner*—L. J. Casaregola
*Attorney, Agent, or Firm*—Kenyon & Kenyon Reilly Carr & Chapin

[57] ABSTRACT

A side-channel ring compressor including compressor medium inlet and outlet openings communicative with the side-channel thereof, and a channel break disposed between the inlet and outlet openings. The channel break has at least one first outlet opening communicative therewith, and the side channel has a second inlet opening, disposed between the compressor medium inlet and outlet openings, which is communicative with the side channel at a point at which the pressure of the compressor medium is greater than the medium pressure at the side-channel inlet opening and less than the medium pressure at the side-channel outlet opening. A fluid transmission line is coupled to the first outlet and second inlet openings, and directs compressed gas from the channel break into the side channel between the compressor medium inlet and outlet openings. At least part of the compressed gas trapped between the blades of the impeller of the compressor is thereby removed.

2 Claims, 1 Drawing Figure

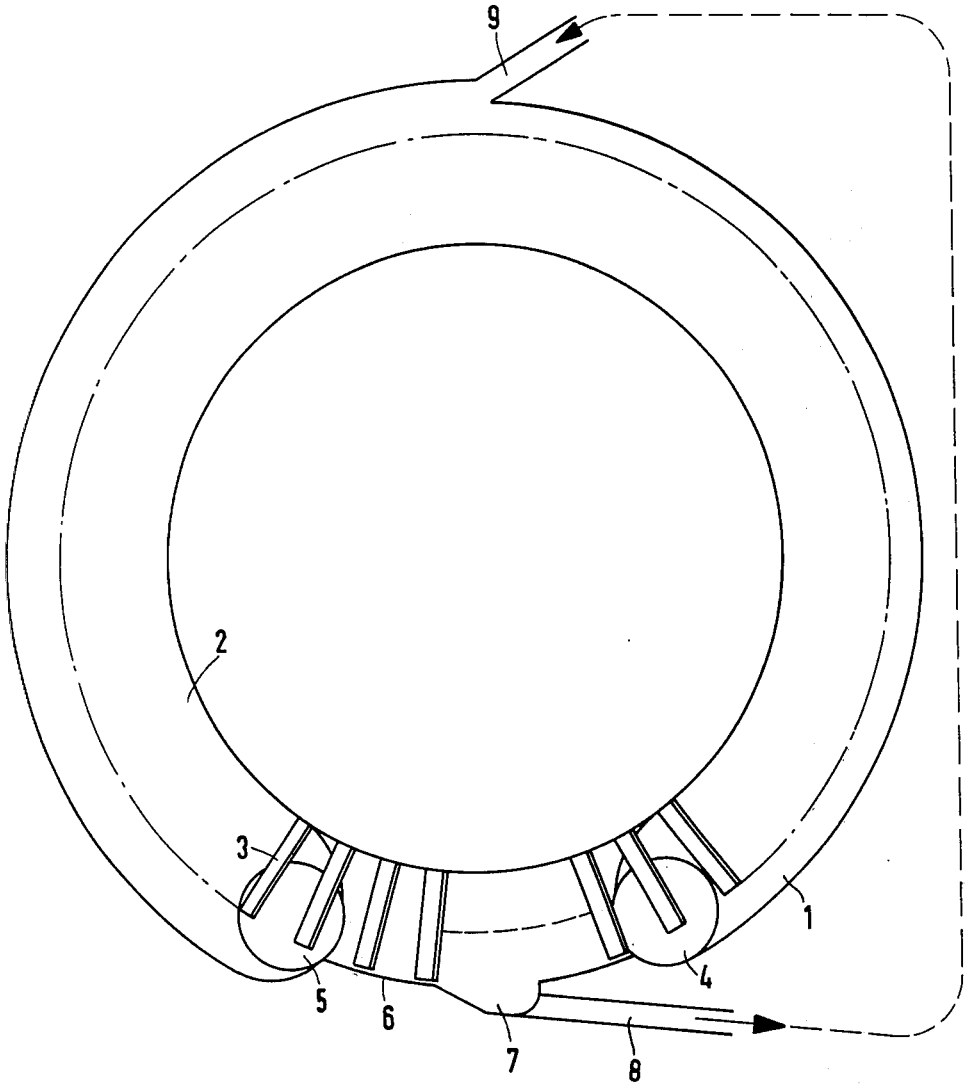
9
2
3
1
4
5
6
7
8

SIDE CHANNEL RING COMPRESSOR

BACKGROUND OF THE INVENTION

1. Field of the Invention

This invention relates generally to side-channel ring compressors, and in particular to an improved side channel construction for such ring compressors by means of which compressed gas is exhausted from between the impeller blades of the compressor as it passes through the side-channel break thereof, and is subsequently directed into the side-channel at a point between the compressor medium inlet and outlet openings of the channel.

2. Description of the Prior Art

Generally speaking, in side-channel ring compressors in which compression ratios greater than 1.2 are produced, the compressed fluid medium disposed between the blades of the compressor impeller is moved past the outlet opening of the side-channel and through the compressor break disposed between the channel inlet and outlet openings. This compressed gas expands into the side channel as it reaches the suction side thereof at the compressor medium inlet opening, and thereby restricts the flow of compressor medium into the side channel. As a result, both the efficiency of the compressor and the pressure ratio attainable therein are significantly reduced.

SUMMARY OF THE INVENTION

It is therefore an object of the present invention to provide an improved side-channel ring compressor construction and to overcome the aforementioned disadvantages of heretofore known side-channel ring compressors.

These and other objects of the invention are achieved in a side-channel ring compressor which includes compressor medium inlet and outlet openings communicative with the side channel of the compressor, and a channel break disposed between the inlet and outlet openings. The improvement of the invention comprises the provision of at least one first outlet opening in the side-channel break which is communicative therewith and a second inlet opening in the side channel disposed between the compressor medium inlet and outlet openings which is communicative therewith at a point in the side-channel wherein the pressure of the compressor medium is greater than the medium pressure at the side channel inlet opening and less than the medium pressure at the side channel outlet opening. A fluid transmission line is coupled to the first and second inlet and outlet openings and directs compressed gas exhausted from the channel break through the first outlet opening into the side channel between the compressor medium inlet and outlet openings in order to prevent the restriction of the intake of compressor medium at the side channel inlet opening.

These and other novel features of the invention will be described in greater detail in the following detailed description.

BRIEF DESCRIPTION OF THE DRAWING

The drawing is a schematic illustration of an improved side-channel ring compressor constructed according to the invention.

DETAILED DESCRIPTION

Referring now to the drawing, there is shown a side-channel ring compressor including a side channel 1 and a compressor impeller 2 having radially outwardly extending blades 3 disposed thereon. The compressor also includes a compressor medium inlet opening 4 and a compressor medium outlet opening 5 both of which are communicative with side channel 1. A channel break 6 is disposed between openings 4 and 5 and is also communicative with side channel 1.

At least one first outlet opening 7 is provided in channel break 6 and is communicative therewith for exhusting compressed gases from channel break 6. A second inlet opening 9 is provided in the compressor in side channel 1 between inlet and outlet openings 4 and 5. Opening 9 is communicative with the side channel at a point therein at which the pressure of the compressor medium is greater than the medium pressure at inlet opening 4 and less than the medium pressure at outlet opening 5. A fluid transmission line 8 is coupled to openings 7 and 9 and directs the compressor medium exhausted from channel break 6 through opening 7 into side channel 1 through inlet opening 9. The position of opening 9 is chosen so that the pressure of the compressor medium at that opening corresponds to the pressure to which the gas exhausted from channel break 6 at opening 7 expands. The radial width of side channel 1 is preferably greater between opening 9 and compressor medium outlet opening 5 than between inlet opening 4 and opening 9 by a distance which is proportional to the increase in flow volume caused by the gas exhausted from channel break 6 and injected into side channel 1 at an opening 9.

It should be noted that although only one outlet opening 7, and one fluid transmission line 8, have been illustrated and described herein, a plurality of outlet openings 7 and fluid transmission lines 8 may be utilized in order to exhaust compressed gases from the channel break of the compressor.

In operation, the compressor medium is drawn into side channel 1 through inlet opening 4 and is compressed by impeller 2 as it is rotated therein. Most of the compressed gas is then exhausted through outlet opening 5. Some of the compressed gas, however, is trapped between blades 3 of impeller 2 and is therefore moved into and through channel break 6. This compressed gas is exhausted from channel break 6 through outlet opening 7 and fluid transmission line 8, and is directed back into side channel 1 through inlet opening 9. In this manner, the gas trapped between the impeller blades is divided into a plurality of components before it reaches the inlet opening 4 of side channel 1. The component which is exhausted through opening 7 expands to an intermediate pressure and is, as has already been described, directed back into the side channel 1 at a point having a corresponding pressure. That gas which is exhausted from channel break 6 therefore no longer restricts the compressor medium intake at inlet opening 4. Less power is thus required to operate the compressor, at the same or an increased flow volume.

In the foregoing specification, the invention has been described with reference to specific exemplary embodiments thereof. It will, however, be evident, that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In a side-channel ring compressor including compressor medium inlet and outlet openings communicative with the side channel of said compressor, and a channel break disposed between said inlet and outlet openings, the improvement comprising, said side channel break having at least one first outlet opening communicative therewith, and said side channel having a second inlet opening, disposed between said compressor medium inlet and outlet openings, which is communicative therewith at a point in said side channel wherein the pressure of said compressor medium is greater than the medium pressure at said side channel inlet opening and less than the medium pressure at said side channel outlet opening, and a fluid transmission line, coupled to said first and second openings, for exhausting compressor medium from said channel break through said first outlet opening and directing said exhausted medium into said side channel between said compressor medium inlet and outlet openings through said second inlet opening.

2. In the side-channel ring compressor recited in claim 1, said side channel having a radial width between said second inlet opening and said compressor medium outlet opening which is greater than the radial width thereof between said second inlet opening and said compressor medium inlet opening.

* * * * *